United States Patent [19]

Tomioka et al.

[11] Patent Number: 5,060,594

[45] Date of Patent: Oct. 29, 1991

[54] APPARATUS FOR PAINTING

[75] Inventors: Yoshio Tomioka; Toshio Soma; Kengo Takano; Mikio Kobayashi, all of Sayama, Japan

[73] Assignee: Honda Giken Kogyo Kabushiki Kaisha, Tokyo, Japan

[21] Appl. No.: 523,678

[22] Filed: May 15, 1990

[30] Foreign Application Priority Data

Jun. 23, 1989 [JP] Japan ..... 1-159712
Jul. 3, 1989 [JP] Japan ..... 1-169906
Oct. 19, 1989 [JP] Japan ..... 1-270309

[51] Int. Cl.[5] ..... B05D 5/00; F26B 3/28

[52] U.S. Cl. ..... 118/666; 118/64; 118/69; 118/314; 118/324; 118/643

[58] Field of Search ..... 118/64, 69, 314, 324, 118/642, 643, 666; 156/380.9; 250/504 R

[56] References Cited

U.S. PATENT DOCUMENTS 4,711,790 12/1987 Morishige ..... 118/666
4,771,728 9/1988 Bergman ..... 118/642

FOREIGN PATENT DOCUMENTS 52-30170 8/1977 Japan .
63-305965 12/1988 Japan .
9000970 2/1990 World Int. Prop. O. ..... 156/380.9

OTHER PUBLICATIONS

Abstract of Japanese Unexamined Patent Application No. (Sho) 63-104681 (A) May 10, 1988.

*Primary Examiner*—Richard V. Fisher
*Assistant Examiner*—Charles K. Friedman
*Attorney, Agent, or Firm*—Armstrong, Nikaido, Marmelstein, Kubovcik & Murray

[57] ABSTRACT

Method including painting a water-based paint onto an article to obtain a water-based paint coat, initially predrying the water-based paint coat by heating with far infrared rays, further predrying the water-based coat by heating with hot air, and thereafter painting either water-based paint or oil-based paint on top of the water-based paint coat. The article can be forcibly cooled with cold air after the further predrying step. The apparatus includes a front-stage paint booth for painting therein a water-based paint to obtain the water-based paint coat, a first predrying chamber in line with and after the front-stage paint booth and having devices for heating with far infrared rays, a second predrying chamber in line with and after the first predrying chamber and having devices for heating with hot air, and a rear-stage paint booth in line with and after the second predrying chamber for painting therein either the water-based paint or the oil-based paint.

11 Claims, 4 Drawing Sheets

APPARATUS FOR PAINTINGcBACKGROUND OF THE INVENTION

This invention relates to a method and an painting in which a water-based paint or an oil-based paint is painted on top of a water-based paint coat in a wet-on-wet manner.

Conventionally, after a coat of a water-based paint has been obtained by painting an article to be painted in a front-stage paint booth, the moisture content of the coat is evaporated in a predrying chamber in which heating with hot air takes place. A water-based paint is thereafter painted over the first coat in a rear-stage paint booth (see Japanese Published Examined Patent Application No. 30170/1977).

In the above-mentioned conventional method, since the coat is heated by hot air on the surface thereof, the surface of the coat is dried in the form of a film and further drying of the moisture content in the coat is likely to be disturbed. Therefore, predrying takes a long time and productivity becomes low.

SUMMARY OF THE INVENTION

This invention has been made in view of these problems and has an object of providing a method and an apparatus for painting in which the time required in predrying can be shortened and productivity can be improved.

In order to attain the above-mentioned object, the method of this invention is a method of painting in which a water-based paint or an oil-based paint is painted on top of a water-based paint coat in a wet-on-wet manner, comprising the following steps. A first coat of a water-based painted is created. A first or initial predrying step of heating is performed with far infrared rays after the water-based paint coat has been obtained by painting. A second or further predrying step of heating with hot air is performed. Thereafter, the water-based paint or the oil-based paint is painted on top of the water-based paint coat.

The apparatus of this invention is a painting apparatus for carrying out the above-mentioned method. A first predrying chamber in which heating with far infrared rays is performed and a second predrying chamber in which heating with hot air is performed are provided between and in a line with a front-stage paint booth for painting a water-based paint to obtain the water-based paint coat and a rear-stage paint booth for painting the water-based paint or the oil-based paint, in the order mentioned from the side of the front-stage paint booth.

By performing far infrared heating in the first predrying step, the far infrared rays penetrate into the inside of the water-based paint coat. Therefore, the coat is rapidly heated to the inside and the moisture content within the coat moves towards the surface thereof. Then, by performing heating with hot air in the second predrying chamber, this moisture content can be well and quickly evaporated.

Further, through this second predrying step, the moisture content in that portion of the coat which is hardly subjected to far infrared rays can be evaporated.

In case the oil-based paint is painted in the rear-stage paint booth, defects in an oil-based paint coat due to rapid evaporation of solvents or defoaming are likely to occur if the temperature of an article to be painted is high. Therefore, according to another feature of this invention, a cooling chamber is provided between the second predrying chamber and the rear-stage paint booth so that, after the second predrying step has been finished, the article to be painted can be cooled in the cooling chamber by blowing cold air on it. According to this arrangement, the cooling time can be made shorter than when the article to be painted is left in a natural condition. Further, since air is blown onto the surface of the water-based paint coat, the evaporation of the moisture content can be accelerated more than when the article to be painted is left in a natural condition.

By providing an air curtain zone respectively between the front-stage paint booth and the first predrying chamber, between the first predrying chamber and the second predrying chamber, between the second predrying chamber and the cooling chamber, and between the cooling chamber and the rear-stage paint booth, the paint particles, hot air and cold air can be prevented from entering the adjacent chambers. Further, by making the lengths of the air curtain zones which are positioned between each of the paint booths and each of the adjacent chambers, substantially equal to, or longer than, that of the article to be painted, there is no chance that each of the paint booths and the adjoining chambers will be intercommunicated through an interior of the article to be painted, such as an automobile cabin. Consequently, the paint particles can securely be prevented from entering each of the chambers.

Further, by making the cross-sectional areas of the first and the second predrying chambers, normal to the transport direction of the article to be painted, smaller than those of the paint booths, thermal efficiency can be improved and the layout of the apparatus can be advantageously made in respect of space.

A case is considered in which far infrared heaters are provided in the first predrying chamber so that far infrared rays can be radiated from the upper side and the lateral sides, and so that the moisture content in the coat is evaporated by passing an automobile body through the predrying chamber. Here, even though the output of each heater is controlled so that the temperature distribution inside the predrying chamber becomes uniform, the roof of the automobile body is liable to be overheated when the bonnet and the trunk lid are sufficiently heated because of the difference in the distance between the heaters and the bonnet and the trunk lid, and the distance between the heaters and the roof.

In order to solve this kind of inconvenience, far infrared heaters for radiating the far infrared rays from the upper side are provided in the first predrying chamber at least in two front and rear stages. The surface temperature of the automobile body which has been heated by the front-stage far infrared heaters is detected and, depending on the detected temperature, the amount of radiation of the far infrared rays from the far infrared heaters of the rear stage may be controlled.

Further, in case a heat source is provided in a third predrying chamber in which the coat painted in the rear-stage paint booth is dried, and a water-based paint is painted in the rear-stage paint booth on top of the water-based paint coat previously obtained, a predrying step for evaporating the moisture content in the coat by heating is performed with the heat source kept switched on. In case an oil-based paint is painted in the rear-stage paint booth on top of the water-based paint coat, the heat source is kept switched off and a setting step for naturally evaporating the solvents in the coat is performed in the predrying chamber. If, in this case, the heat source is constituted by far infrared heaters, the heaters are constructed such that far infrared rays are radiated by heating ceramics and the like placed in the peripheries thereof. Therefore, if the heaters are operated by switching on and off as mentioned above, waiting time is required, until the heaters heat up or cool off sufficiently so that radiation of far infrared rays starts or stops. This results in a long time in the predrying step and the setting step, and productivity becomes low.

In this case, a shielding means may be provided such that it can be changed over between a position in which the front of the heat source comprising the far infrared heaters in the third predrying chamber is kept closed and a position in which the front of the heat source is kept open. In case a water-based paint is painted in the rear-stage paint booth, the shielding means may be changed over to the position in which the front of the heat source is kept open, thereby heating and evaporating the moisture content of the coat of paint. In case an oil-based paint is painted, the shielding member is changed over to the position in which the front of the heat source is kept closed, thereby permitting natural evaporating of the solvent in the oil-based paint without extra heating. In this manner, the predrying step and the setting step can be performed by changing over the shielding means while the heat source is kept switched on. Therefore, the waiting time to wait for the infrared rays to start radiation is not required any more, and the time required for the predrying step and the setting step can be shortened.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
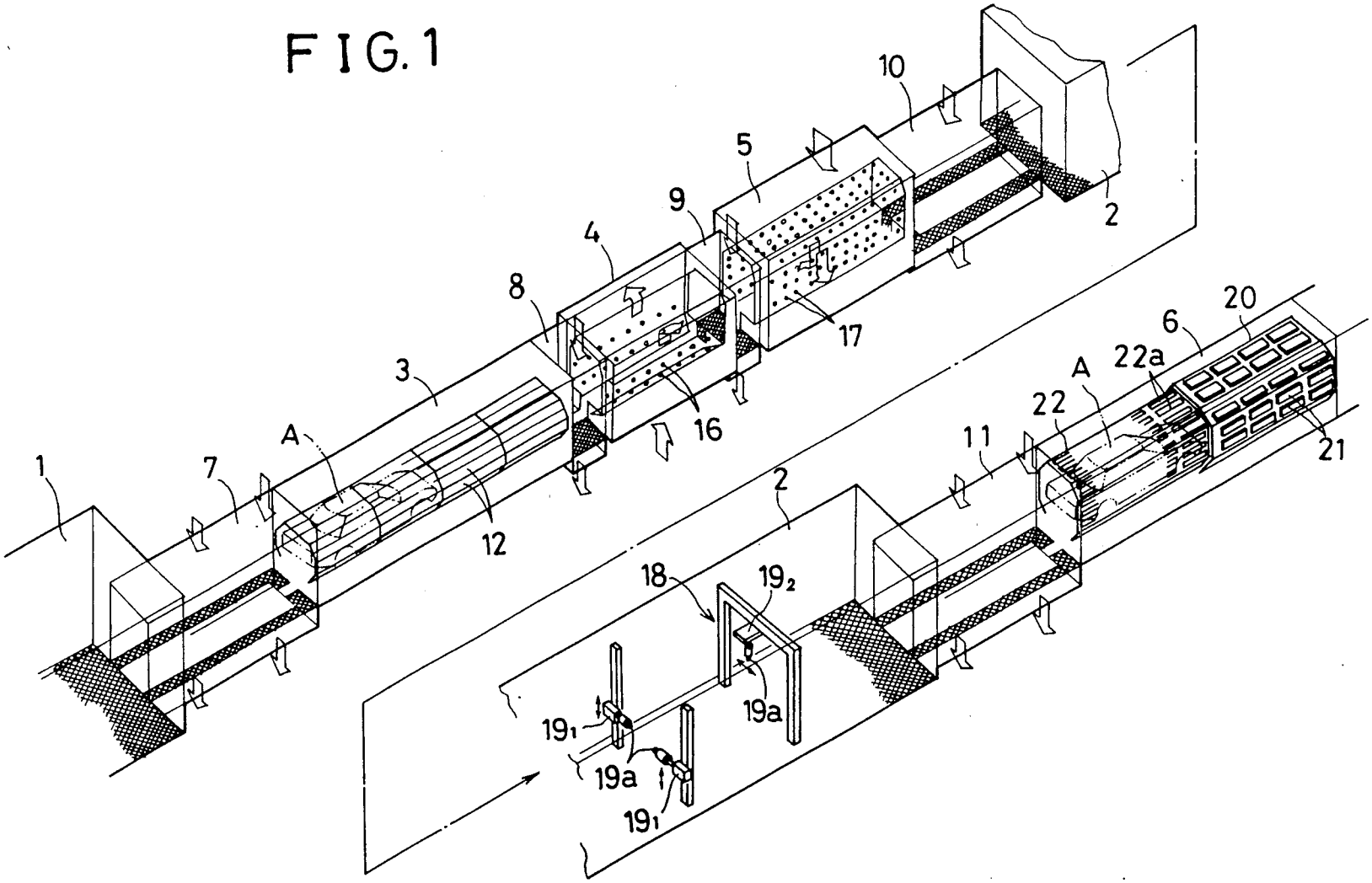
FIG. 1 is a perspective view of a painting line provided with one example of an embodiment of this invention.
Figure 2:
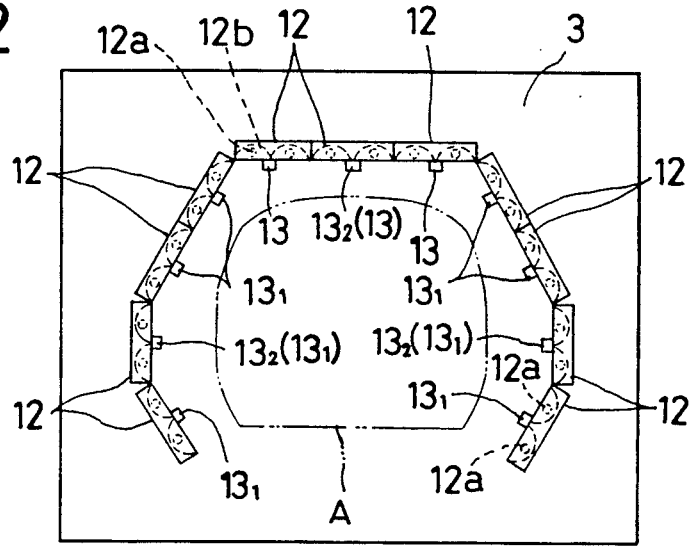
FIG. 2 is a cross-sectional view of a first predrying chamber.

Referring to FIG. 1, a front-stage paint booth 1 in which a water-based paint for a water-based paint coat is painted on an automobile body A (which is an article to be painted), and a rear-stage paint booth 2 in which a water-based paint or an oil-based paint is painted on top of the water-based paint coat in a wet-on-wet manner are arranged in a line. Between both paint booths 1, 2, a first predrying chamber 3 for performing heating therein with far infrared rays, a second predrying chamber 4 for performing heating therein with hot air and a cooling chamber 5 for performing forcible cooling therein with cold air are provided in the order mentioned from the side of the front-stage paint booth 1. A third predrying chamber 6 is provided in the rear of the rear-stage paint booth 2 for drying the coat which is painted in the rear-stage paint booth 2. Air curtain zones 7, 8, 9, 10, 11 are respectively provided in the space between the front-stage paint booth 1 and the first predrying chamber 3, between the first predrying chamber 3 and the second predrying chamber 4, between the second predrying chamber 4 and the cooling chamber 5, between the cooling chamber 5 and the rear-stage paint booth 2 and between the rear-stage paint booth 2 and the third predrying chamber 6.

An arrangement can be used omitting the cooling chamber 5, wherein a paint is painted on top of the water-based paint coat after the automobile body A which is heated by hot air in the second predrying chamber 4 has been naturally cooled.

Figure 4:
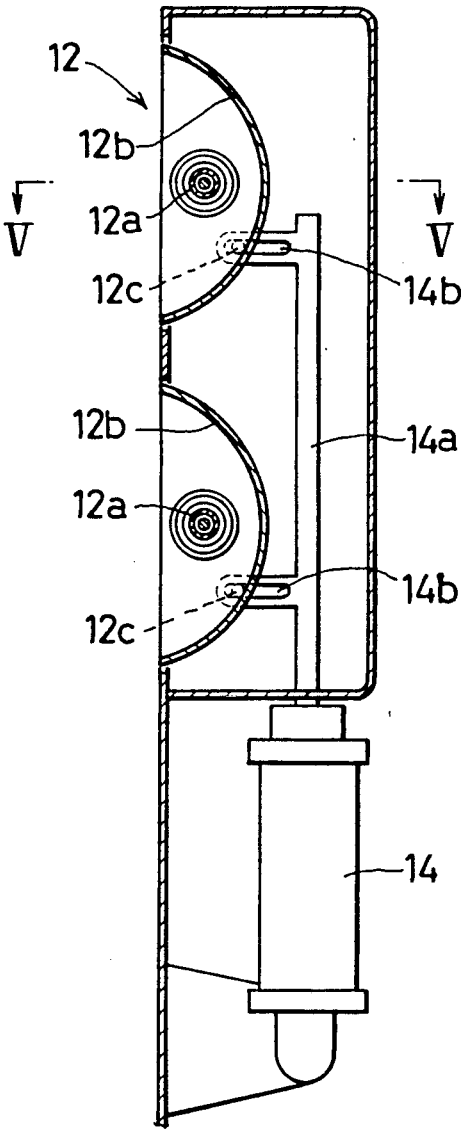
FIG. 4 is an enlarged sectional side view of the heater shown in FIG. 3.

In the above-mentioned first predrying chamber 3, far infrared heaters 12 are arranged in three units across in the width direction of the automobile body in the upper side of the chamber in four front and rear stages for a total of twelve upper units. Four units of far infrared heaters 12 are arranged in the vertical direction on each of the right and left sides of the chamber in four front and rear stages for a total of thirty-two vertically arranged units so that the automobile body A can be radiated with far infrared rays from the upper side as well as from the right and the left sides. Each of the heaters 12 includes two far infrared lamps **12*a* as shown in FIG. 4**.

Figure 3:
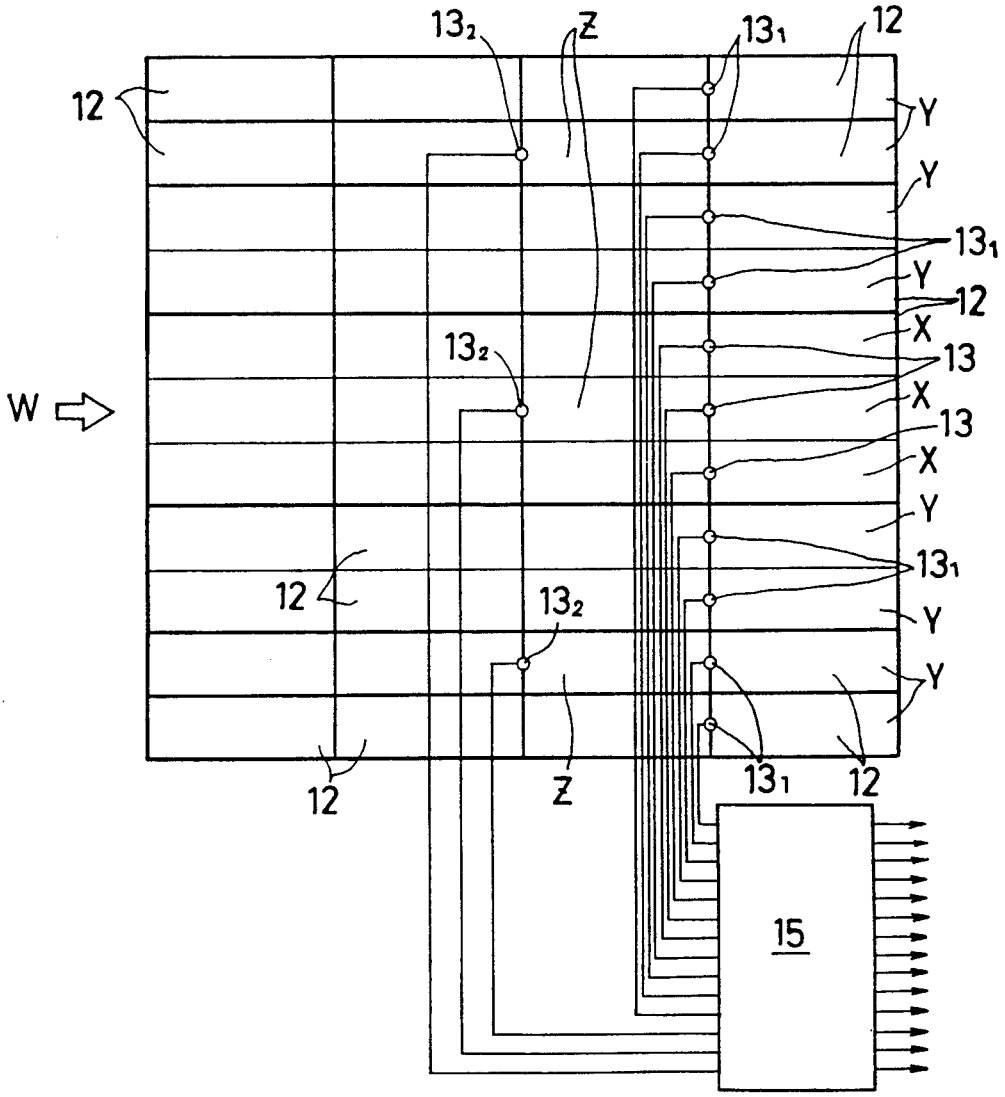
FIG. 3 is a development diagram of infrared heaters in the first predrying chamber.

In FIG. 3, the automobile is to be transported in the direction shown by an arrow W.

Even though the output of each heater 12 is controlled so that the temperature profile inside the first predrying chamber 3 is uniform, the roof of the automobile is liable to be overheated if the bonnet and the trunk lid are sufficiently heated because of the difference in distances between the heater 12 and the bonnet and the trunk lid of the automobile body A, and between the heater 12 and the roof. Therefore, non-contact type infrared temperature measuring devices 13 for measuring the surface temperature of the automobile body are provided respectively at the border between each upper heater 12 in the rearmost stage (as indicated by X in FIG. 3) and the heater 12 in the adjoining front stage. A control means is provided to control the amount of radiation of infrared rays of each heater 12 indicated by X according to a detected signal from each of the infrared temperature measuring devices 13. The control means (as shown in part in FIGS. 3–6) comprises an invertible reflector **12*b* which is rotatably mounted on the infrared lamp 12*a* of each heater 12 indicated by X, an actuator 14 comprising a cylinder and the like to invert each of the reflectors 12*b*, and a controller 15 with built-in microcomputer to control the operation of each of the actuators 14**.

Figure 6:
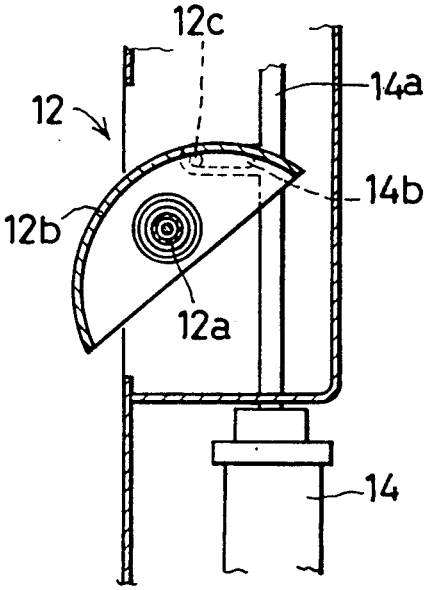
FIG. 6 is a sectional view showing the shielding position of a reflector.

A pin **12*c* provided in a projecting manner at the end of each reflector 12*b* is engaged with a slot 14*b* of an actuating rod 14*a* of each actuator 14. The operation of each of the actuators 14 inverts the respective reflector 12*b* between a radiating position, as shown in FIG. 4, in which the reflector 12 is positioned at the back of the lamp 12*a* and a shielding position, as shown in FIG. 6, in which the reflector 12 is positioned in front of the lamp 12*a*. The controller 15 monitors the input of the detected signal from each of the temperature measuring devices 13 and inverts the individual reflectors 12***b* from the radiating position to the shielding position through an output signal when the temperature of the automobile body heated by each of the heaters 12 in the previous stage is higher than a predetermined set value.

Further, in the present embodiment, the amount of radiation of far infrared rays from each of the right-side and left-side heaters 12 of the rearmost stage in the first predrying chamber 3 is also controllable.

More specifically, infrared temperature measuring devices $13_1$ for measuring the temperature of the automobile body heated by the heaters of the previous stage, are provided at the border between the right-side and left-side heaters 12 in the rearmost stage (as indicated by Y in FIG. 3) and the adjacent front-stage heaters 12. The reflector for each of the heaters 12 indicated by Y is constructed, in the same manner as described above, to be inverted between the radiating position and the shielding position by means of each actuator. By inputting the detected signal from each of the measuring devices $13_1$, each of the reflectors is inverted through an output signal from the controller 15.

Further, the right-side and left-side heaters 12 in the first predrying chamber 3 are arranged in a curved manner to substantially follow the side configuration of the automobile body A. In the side central portion of the automobile body A, the temperature rise is quicker than the upper and the lower side portions which have a multi-layer panel construction. The temperature rise in the upper central portion of the automobile body A is also quicker than that at both sides thereof. Therefore, there is a fear that the upper central portion and the side central portion of the automobile body are overheated even though, as described above, the amount of radiation of infrared rays is controlled.

In this situation, the apparatus may be arranged so that the amount of radiation of far infrared rays from each of the heaters 12 in the second stage from the front side in the transport direction, can be controlled as described above. But this requires many temperature measuring devices and actuators for inverting the reflectors, resulting in an expensive equipment cost.

Thus, in the present embodiment, infrared temperature measuring devices 132 are provided for measuring the surface temperature of the automobile body in the borders between the central heater 12 in the second stage of the upper side of the first predrying chamber as indicated by Z as well as each of the central heaters 12 in the second stage of the right and left sides as indicated by Z, and each of the adjacent heaters in the previous stage. The reflector of each heater 12 indicated by Z is invertible, in the same manner as previously described, between the operating position and the shielding position. By inputting the detected signal from each of the measuring devices $13_2$ to the controller 15, the reflector of each heater 12 indicated by Z can be inverted in order to control the amount of radiation of far infrared rays.

If the amount of radiation of infrared rays from each of the heaters 12 is immediately controlled by the detected signal from each of the temperature measuring devices, certain situations occur which are explained hereinbelow. If the transport speed of the automobile body A is relatively low or the length of each heater 12 is long, when the rear end of the roof has passed right below the infrared temperature measuring device 13, $13_2$ and the surface temperature at the trunk portion is measured, far infrared rays are radiated from each upper side heater 12 in the rear stage to the roof even though the roof is situated right below each heater 12.

For this reason, it is preferable to provide a time lag in controlling the amount of radiation of the far infrared rays based on the detected signal from each measuring device 13, $13_1$, $13_2$.

Although in the present embodiment, the reflector 12*b* of each heater 12 is invertible, the arrangement needs not be limited thereto; direct intervening shield plates which can shield the radiation of far infrared rays may be provided in front of each heater 12, or far infrared lamps 12*a* may be controlled by turning them on and off.

In both sides of the interior wall of the second predrying chamber 4, many blow holes 16 are provided so that hot air can be blown out of these blow holes 16 towards the automobile body A. In both side walls and the upper wall of the cooling chamber 5, many blow holes 17 are also provided so that cold air can be blown out of these blow holes 17 towards the automobile body A.

Each of the air curtain zones 7, 8, 9, 10, 11 is constructed so that air flows from the upper side towards the lower side. The lengths of the air curtain zone 7 between the front-stage paint booth 1 and the first predrying chamber 3, of the air curtain zone 10 between the cooling chamber 5 and the rear-stage paint booth 2, and of the air curtain zone 11 between the rear-stage paint booth 2 and the third predrying chamber 6 are made slightly longer than the length of the automobile body. In this manner, when the automobile body A passes through each of the air curtain zones 7, 10, 11, the paint particles in each of the paint booths 1, 2 are securely prevented from entering each of the chambers 3, 5, 6 which are adjacent to each of the paint booths 1, 2 through intercommunication of the paint booths 1, 2 with the adjacent chambers 3, 5, 6 via the inner space of the automobile body A.

Further, the cross-sectional areas, of the first and the second predrying chambers 3, 4 normal to the direction of transportation of the automobile body A, are smaller than those of the paint booths 1, 2 so that the improvement of the thermal efficiency as well as the reduction in space can be attained.

A painting apparatus for water-based paint and a painting apparatus for oil-based paint may be respectively provided in the rear-stage paint booth 2. However, this makes the paint booth congested and the equipment cost expensive to provide both inside of one paint booth. Therefore, in the present embodiment, a common paint apparatus for water-based paint and for oil-based paint is provided in the paint booth 2.

The paint apparatus 18 comprises, as shown in FIG. 1, vertically movable reciprocators $19_1$ for painting the side surfaces, and a laterally movable reciprocator $19_2$ for painting the upper surface. Paint heads 19*a* such as air spray guns, rotary atomizers, and the like are mounted on the reciprocators $19_1$, $19_2$ A water-based paint and an oil-based paint can be interchangeably fed to the heads 19*a*. When the water-based paint is changed over to the oil-based paint, the paint supply pipes connected to the paint heads 19*a* are supplied in succession with water, hydrophilic solvents and solvents in order to wash them. When the oil-based paint is changed over to the water-based paint, the paint supply pipes are supplied in succession with solvents, hydrophilic solvents and water to wash them.

Figure 8:
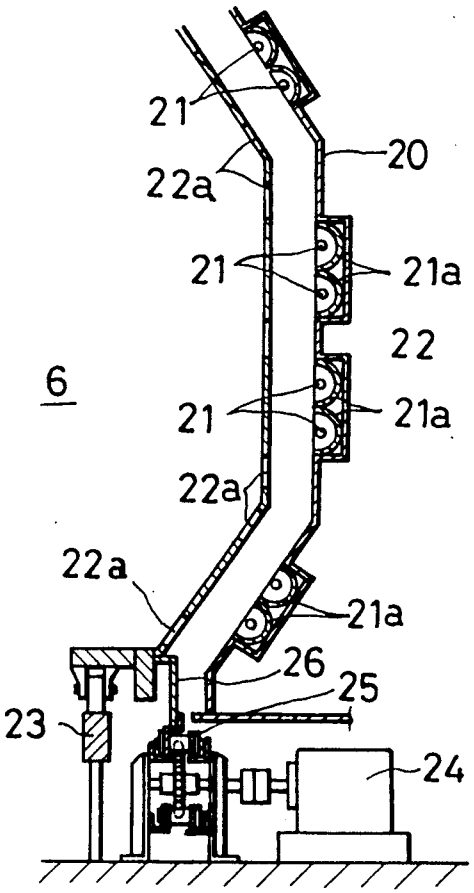
FIG. 8 is a sectional side view of an important portion thereof.
Figure 7:
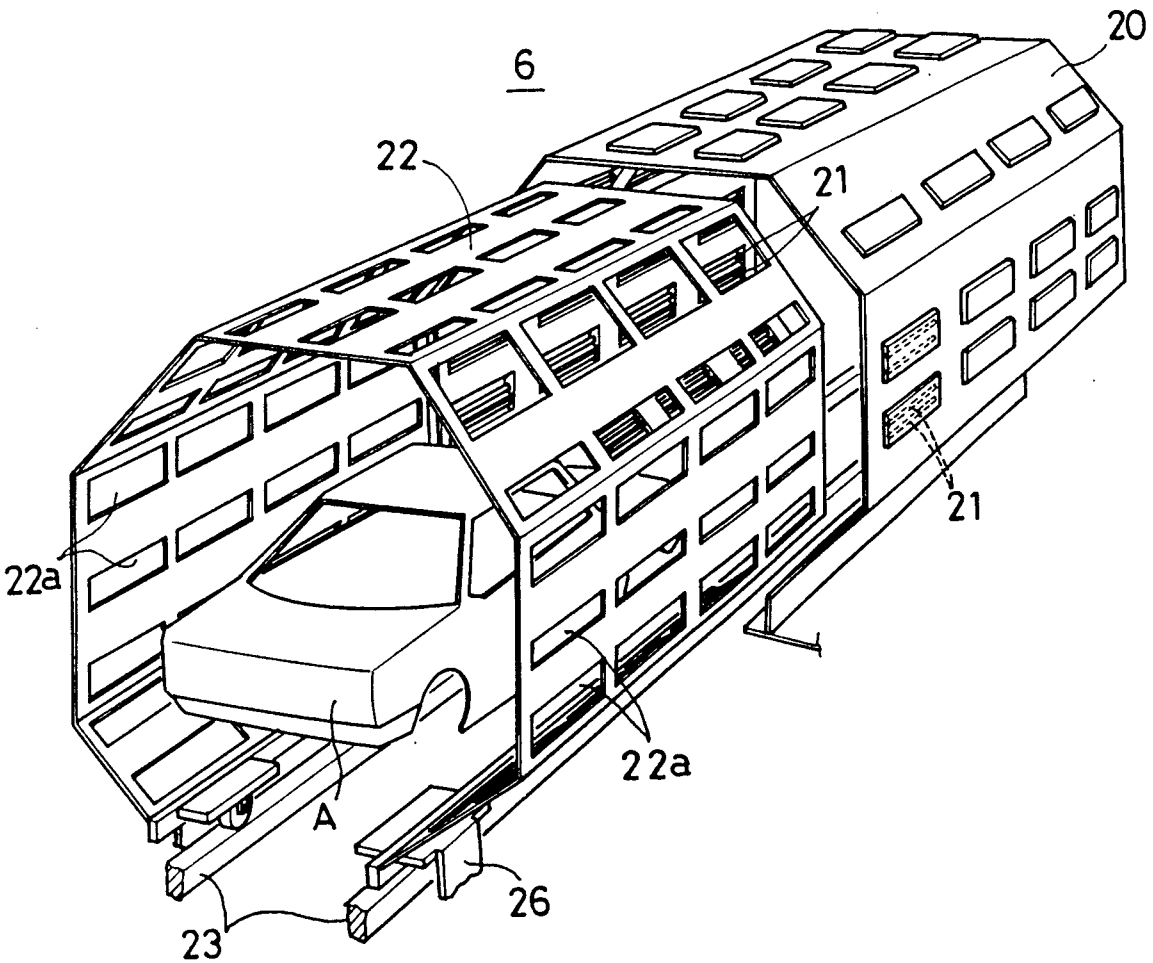
FIG. 7 is a perspective view of a supporting frame and a shielding frame in a third predrying chamber.

In the third predrying chamber 6 there is provided, as shown in FIGS. 7 and 8, a supporting frame 20 which carries a heat source for radiation heating is formed in a tunnel shape through which the vehicle body A is able to pass. Many far infrared heaters 21 are provided on both side-surfaces and on the upper surface of the supporting frame 20 so that the automobile body A can be radiated with far infrared rays from the heaters 21 from the upper side and from the lateral sides. Further, shielding means is provided which can be changed over between a position in which the front of the heaters 21 is kept open and a position in which they are closed.

In this embodiment, the shielding means comprises a shielding frame 22 which is formed into a frame shape substantially similar to the supporting frame 20 and which is insertable into, and withdrawable from, the supporting frame 20. The shielding frame 22 is mounted on a pair of rails 23, 23 which are laid in the third predrying chamber 6. An endless chain 25 driven by a motor 24 is provided at the bottom of the predrying chamber 6. An arm piece 26 fixed to the shielding frame 22 is connected to the endless chain 25 so that the shielding frame 22 can be inserted into and withdrawn from the supporting frame 20 by the motor 24. In this manner, therefore, the front of the heaters 21 can be shielded by inserting the shielding frame 22 into the supporting frame 20 and the front of the heaters 21 can be kept open by withdrawing the shielding frame 22 from the supporting frame 20. The shielding frame 22 is made of stainless steel plates whose outer surfaces are mirror-finished. Those portions which correspond to the pitch of arrangement of the heaters 21 (i.e. the spaces between heaters) are provided with a plurality of holes 22*a* in order to lighten the shielding frame 22.

Figure 5:
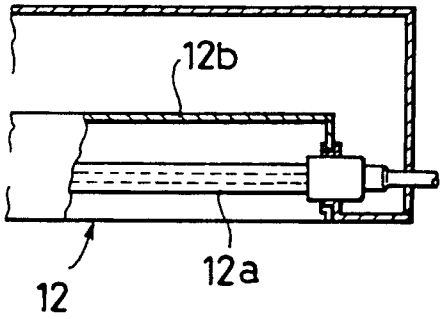
FIG. 5 is a sectional view taken along the line V—V in FIG. 4.

While it is possible to have the shielding means be a mechanism on the reflector 21*a* of each heater 21 by arranging the reflector 21*a* in an invertible manner like the reflector 12*b* shown in FIGS. 4 through 6, it is advantageous that the shielding means be constituted by the shielding frame 21 as described above, because all the heaters 21 can be opened and closed by a single member.

Next, the method of painting with the above-mentioned painting apparatus is explained.

After having been painted with a water-based paint for the water-based paint coat in the front-stage paint booth 1, an automobile body is heated with far infrared rays in the first predrying chamber 3 for about 2 minutes. Then, the body is heated for about 1 minute in the second predrying chamber 4 and is blown with cold air for about 1 minute in the cooling chamber 5. As a result, the moisture content in the water-based paint coat is almost completely evaporated, and the temperature of the automobile body reaches about 20° C.

In the conventional method in which the predrying step is performed only by heating with hot air, it used to take 10 to 15 minutes.

After the above-mentioned steps, painting is performed in the rear-stage paint booth 2. When water-based paint is painted in the paint booth 2 on top of the water-based paint coat, the shielding frame 22 is changed over to the position in which the front of the far infrared heaters 21 is kept open, and heating with far infrared rays is performed in the third predrying chamber 6 to evaporate by heating the moisture content in the coat. When oil-based paint is painted on top of the water-based paint coat, the shielding frame 22 is changed over to the position in which the front of the far infrared heaters 21 is closed, and a setting step is performed in the third predrying chamber 6 in order to naturally evaporate the solvent in the coat.

If the transport conveyor in the painting line is stopped due to a problem during the painting work, the shielding frame 22 is changed over to the position in which the front of the heaters 21 is closed, thus preventing the automobile body A in the third predrying chamber 6 from being overheated.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for painting in which a water-based paint or an oil-based paint is painted on top of a water-based paint coat in a wet-on-wet manner, comprising a front-stage paint booth for painting therein a water-based paint to obtain the water-based paint coat, a first predrying chamber in a line with and after said front-stage paint booth and having means for heating with far infrared rays, a second predrying chamber in a line with and after said first predrying chamber and having means for heating with hot air, a cooling chamber for forcibly cooling with cool air, in a line with and after said second predrying chamber, and a rear-stage paint booth in a line with and after the cooling chamber, for painting therein one of the water-based paint and the oil-based paint.

2. An apparatus for painting according to claim 1, further comprising air curtain zones provided respectively between the front-stage paint booth and the first predrying chamber, between the first predrying chamber and the second predrying chamber, and between the second predrying chamber and the rear-stage paint booth.

3. An apparatus for painting according to claim 2, wherein the air curtain zone adjacent to the front-stage paint booth and the air curtain zone adjacent to the rear-stage paint booth are substantially equal in length to, or longer than, the article to be painted.

4. An apparatus for painting according to claim 7, further comprising air curtain zones provided respectively between the front-stage paint booth and the first predrying chamber, between the first predrying chamber and the second predrying chamber, between the second predrying chamber and the cooling chamber, and between the cooling chamber and the rear-stage paint booth.

5. An apparatus for painting according to claim 4, wherein the air curtain zone adjacent to the front-stage paint booth and the air curtain zone adjacent to the rear-stage paint booth are substantially equal in length to, or longer than, the article to be painted.

6. An apparatus for painting according to claim 1, wherein the cross-sectional areas of the first and the second predrying chambers, normal to the travel direction of the article to be painted, are smaller than those of the front-stage and the rear-stage paint booths.

7. An apparatus for painting according to claim 1, wherein:

the article to be painted is an automobile body;

said means for heating with far infrared rays includes far infrared heaters for radiating far infrared rays from an upper side provided in the first predrying chamber at least in two front and rear stages; and said apparatus further comprises:

temperature detecting means in said first predrying chamber for detecting the surface temperature of the automobile body which is travelling through said first predrying chamber and has been heated by the front-stage far infrared heaters and producing a signal, and control means for controlling the amount of radiation of far infrared rays from the rear-stage far infrared heaters according to the signal produced by the temperature detecting means.

8. An apparatus for painting according to claim 7, wherein the control means comprises:

a reflector provided in each of the rear-stage far infrared heaters which is invertible between a radiating position in which the reflector is located at the rear of the far infrared heater and a shielding position in which the reflector is located in front of the heater;

an actuator for inverting the reflector; and a controller for controlling the actuator according to the signal from the temperature detecting means.

9. An apparatus for painting according to claim 1, further comprising a third predrying chamber for drying a coat painted in the rear-stage paint booth in a line with and after said rear-stage paint booth and having a heat source comprising far infrared heaters and a shielding means changeable over between a shielding position in which the front of the heaters is covered and a radiating position in which the front of the heaters is kept open.

10. An apparatus for painting according to claim 9, wherein the third predrying chamber includes a supporting frame having a large number of the heaters mounted thereon; and the shielding means comprises a shielding frame provided such that it is insertable into, and withdrawable from, the supporting frame, said shielding frame being formed in a form substantially similar to the supporting frame.

11. An apparatus for painting according to claim 1, wherein said rear stage paint booth further comprises a common painting apparatus for painting water based paint and oil based paint.

* * * * *

UNITED STATES PATENT AND TRADEMARK OFFICE

CERTIFICATE OF CORRECTION

PATENT NO. : 5,060,594

DATED : October 29, 1991

INVENTOR(S) : TOMIOKA et al

It is certified that error appears in the above-identified patent and that said Letters Patent is hereby corrected as shown below:

In col. 8, claim 4, line 48, delete "7" and substitute therefor --1--.

Signed and Sealed this

Fourth Day of May, 1993

Attest:

Michael K. Kirk

MICHAEL K. KIRK

Attesting Officer

*Acting Commissioner of Patents and Trademarks*